United States Patent [19]

Sassmannshausen et al.

[11] Patent Number: 4,901,619

[45] Date of Patent: Feb. 20, 1990

[54] SHAPED CHARGE WITH BARRIER PRODUCED IN SITU

[75] Inventors: Ulrich Sassmannshausen, Brühl; Manfred Pietsch, Leverkusen, both of Fed. Rep. of Germany

[73] Assignee: Dynamit Nobel Aktiengesellschaft, Troisdorf, Fed. Rep. of Germany

[21] Appl. No.: 283,213

[22] Filed: Dec. 12, 1988

[30] Foreign Application Priority Data

Dec. 14, 1987 [DE] Fed. Rep. of Germany ..... 3742290

[51] Int. Cl.[4] ..... C06D 1/08; F42B 3/00; F42B 1/00; F42B 1/02

[52] U.S. Cl. ..... 86/20.12; 102/306; 102/307; 102/308; 102/309; 102/310; 102/318; 102/320; 264/3.1

[58] Field of Search ..... 86/20.1, 20.12, 20.14; 102/306, 307, 309, 318, 320, 308, 310; 264/3.1

[56] References Cited

U.S. PATENT DOCUMENTS

| | | | |
|---|---|---|---|
| 3,235,005 | 2/1966 | Delacour | 102/307 |
| 3,255,659 | 6/1966 | Venghiattis | 102/307 |
| 4,342,261 | 8/1982 | Majerus | 102/307 |
| 4,393,014 | 7/1983 | Ziegler | 149/92 |
| 4,543,220 | 9/1985 | Voigt, Jr. | 102/306 |
| 4,627,353 | 12/1986 | Chawla | 102/309 |
| 4,643,097 | 2/1987 | Chawla et al. | 102/306 |
| 4,669,384 | 6/1987 | Chawla et al. | 102/307 |
| 4,724,767 | 2/1988 | Aseltine | 102/307 |
| 4,766,813 | 8/1988 | Winter et al. | 102/307 |
| 4,794,990 | 1/1989 | Riggs | 166/902 |

*Primary Examiner*—Howard J. Locker
*Attorney, Agent, or Firm*—Felfe & Lynch

[57] ABSTRACT

In the inventive shaped charge, the main charge and the propagating charge are held together solely by the barrier. This union is possible (and is distinguished by pronounced freedom from flaws) because the barrier is produced directly in the cavity in which it is to remain and is able to conform with the utmost accuracy to the surfaces of the charges. The barrier is advantageously formed under vacuum. Factors to be considered in the selection of the barrier material are its fluidifiability, its solidification and shrinkage behavior, and its compatibility with the explosive. Suitable barrier materials include single- or two-component foams, casting compounds, resins and adhesives.

7 Claims, 1 Drawing Sheet

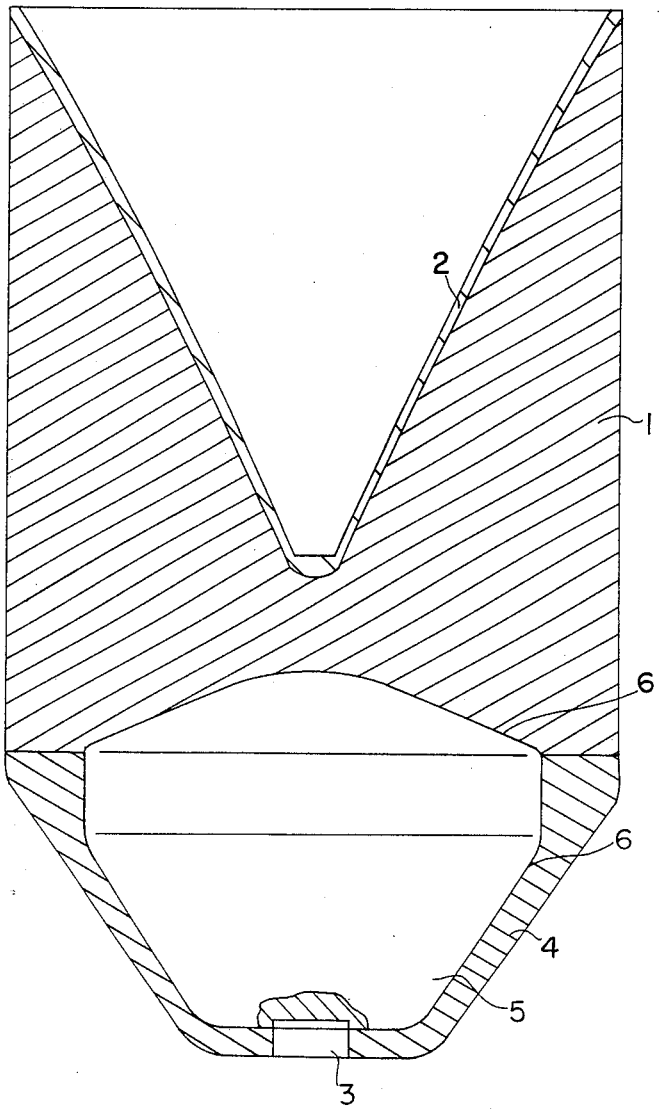
2
1
6
6
4
5
3

SHAPED CHARGE WITH BARRIER PRODUCED IN SITU

BACKGROUND OF THE INVENTION

A shaped charge essentially comprises a main charge (bursting charge) with a conical cavity provided with a liner. The main charge is ignited by a detonator through a propagating charge. For optimum guidance of the detonation waves, a detonation waveguide or "barrier" is disposed in the propagating charge. (See German patent publications 34 08 865 A1, 32 16 684 C2 and 34 28 488 A1).

Shaped charges are manufactured by various methods. An integrated pressing method is known in which all components are pressed in a suitable mold. A barrier made of aluminum, for example, can thus be incorporated in the shaped charge. However, plastics or foams, which make much better damping materials, cannot be processed in this manner since they would sustain mechanical damage because of the high pressure.

For this reason, preformed parts (main charge, propagating charge, barrier) are generally used which need only be united with (e.g., adhesive-bonded to) one another in a mold, for example. (See German patent publication 28 52 358 C2).

It is know that a shaped charge has to be manufactured with high precision and that its axial symmetry should not be flawed if considerable losses in performance are to be avoided. Especially when a shaped charge is assembled from preformed parts, as mentioned above, deviations from flatness are practically impossible to avoid. Two types predominate: Nonuniform bonding, particularly between propagating charge and main charge, and gaps (air inclusions) between barrier and main or propagating charge.

SUMMARY OF THE INVENTION

The invention has as an object to avoid deviations from flatness in the manufacture of a shaped charge, to simplify its assembly generally, and to provide a shaped charge of uniformly high effectiveness, that is, a flawlessly assembled shaped charge.

This object is accomplished through a method wherein the cavity formed by the prefabricated main and propagating charges is filled with a solidifying material while it is still in the fluid state and the material is allowed to solidify and cure or polymerize in the cavity, tenacious bonding to the main and propagating charges being so achieved. The shaped charge is characterized in that the bonding and cohesion of main charge, propagating charge and barrier are essentially due to a barrier produced in situ from a fluidifiable material.

In accordance with the invention, the barrier is formed on a site where it can remain, and optimum conformability exists so that deviations from flatness (faulty bonding) in particular are unlikely to occur.

To be suitable for the formation of a barrier in situ, the material should meet the following requirements: it should be compatible with the explosives used in the shaped charges, it should form at least a minimal bond with the surface of these explosives to assure cohesion of the assembled shaped-charge, the shrinkage behavior of the material should be temperature-independent so that no inhomogeneities in the formed barrier will occur and the barrier will not become partially detached from the main-and/or propagating charge when the temperature fluctuates; and the reaction temperature (during the cure, for example) should not impair the explosive.

Materials which possess these properties are known per se to those skilled in the art.

The union between barrier and explosive may be improved still further, for example, by means of adhesion promoters which are known per se and which are applied to the surfaces of the explosive.

While the above requirements should be taken into consideration by those skilled in the art in selecting an appropriate material for the barrier, they have many suitable materials to choose from. Widely differing classes of materials lend themselves to use as barrier material.

Highly advantageous are single- or two-component foams. Polyurethane foams, for example, make it possible to produce materials of widely differing hardness and density. Moreover, they can be formulated so that they will adhere to the mold, in other words, the explosive. Shaped charges with a barrier of polyurethane foam which satisfy the conditions mentioned have particularly good values with respect to axial symmetry, indicating freedom from flaws.

Casting compounds which do not foam, for example, bitumen or silicon casting compounds, are also quite suitable, provided that they have temperature-independent coefficients of expansion and minimal cure times.

Organic single- or multi-component resins or adhesives are also suitable materials for the barrier. Those skilled in the art will appreciate that additives such as hardeners, density modifiers (e.g., hollow glass spherules) or the like may be incorporated in the fluidifiable material.

The material forming the barrier is introduced into the cavity formed by the main charge and the propagating charge after the two charges have been fixed with each other, for example, by clamping. The material is introduced through a recess which remains in the propagating charge, extends as far as the cavity, and serves to accommodate the detonator.

The cavity may also be filled under vacuum. In this variation of the method, the possibility of faulty bonding between barrier and charge is eliminated even more reliably since no air pockets are able to form.

The invention is illustrated in the accompanying drawing which is a sectional view of a shaped charge in accordance with the invention.

DETAILED DESCRIPTION OF THE PREFERRED EMBODIMENT

Referring more particularly to the drawing, the figure shows a section through a shaped charge. The latter comprises the bursting charge (main charge) 1. The cone has a liner 2 from which the piercing jet of the shaped charge is formed after ignition. As is known, the main charge 1 has to be ignited in a uniform annular manner. To this end, there are disposed between the detonator, which is inserted in the recess 3 after the barrier material poured into the spaced 5 has cured, and the main charge 1 a propagating charge 4 as well as a space 5 filled with the dampening barrier material that should be as light as possible. This mass, which dampens the detonation waves from the detonator, is called barrier. As a result of this barrier 5, produced in accordance with the invention, no deviations from flatness (and particularly faulty bonding, air inclusions, etc.) are present in the zone of transition 6 between it and the main charge 1 or the propagating charge 4.

It has further been found that the barrier produced in accordance with the invention provides outstanding adhesion so that an optimal zone of transition 6 from the propagation charge 4 to the main charge 1 is achieved without additional bonding, through the cohesion of the barrier 5 and the charges 4 and 1 alone.

Once the initially fluid material forming the barrier 5 has solidified sufficiently, the excess material in the space 3 is removed, the detonator is inserted in that space, and the shaped charge is removed from the fixating apparatus (e.g. clamp).

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A method of assembling a shaped charge in a mold, comprising:

fixing separately produced main and propagating charges together leaving a cavity formed by the main charge and by the propagating charge, filling that cavity with a solidifying material while said solidifying material is still in the fluid state, and allowing said material to solidify with temperature-independent shrinkage behavior to form a barrier in the cavity by curing or polymerizing and thereby bonding that material tenaciously to the main charge and the propagating charge.

2. A method according to claim 1, which includes providing with an adhesion promoter, surfaces of at least one of the main charge and the propagating charge which form the cavity.

3. A method according to claim 1, which includes evacuating the air in the cavity while filling the cavity with the solidifying material.

4. A shaped charge comprising:

a cylindric main charge having an upper plane surface and a lower surface plane, said upper plane surface having a cavity with a side-wall, said cavity having the shape of a closed funnel, said main charge having a side liner fixed to said side-wall of said cavity in said main charge, and a separately produced annular propagating charge following said main charge at sail lower surface plane of said main charge;

the annular propagating charge being axially symmetrical and having the form of a cup which is covered by the main charge, a cavity being formed by the main charge and the propagating charge, and an igniting device centrally connected to the propagating charge, and a barrier disposed in the cavity surrounded by the propagating charge and the main charge and being formed of material introduced into the last-mentioned cavity only after the main charge and the propagating charge are united, said material being fluid when introduced into the last-mentioned cavity and solidifying with temperature-independent shrinkage behavior.

5. A shaped charge as defined in claim 4, in which the barrier is formed by a foamed resin.

6. A shaped as defined in claim 4, in which the barrier is formed by a casting compound.

7. A shaped charge as defined in claim 4, in which the barrier is formed by an adhesive.

* * * * *

UNITED STATES PATENT AND TRADEMARK OFFICE

CERTIFICATE OF CORRECTION

PATENT NO. : 4,901,619

DATED : February 20, 1990

INVENTOR(S) : Ulrich Sassmannshausen

It is certified that error appears in the above-identified patent and that said Letters Patent is hereby corrected as shown below:

Column 2, line 61 for "spaced" read -- space --.

Column 4, line 14 for "sail" read -- said --.

Signed and Sealed this

Eighth Day of September, 1992

*Attest:*

DOUGLAS B. COMER

*Attesting Officer*

*Acting Commissioner of Patents and Trademarks*